United States Patent [19]

Oakes

[11] Patent Number: 4,692,733

[45] Date of Patent: Sep. 8, 1987

[54] FUSE FOR AN ALTERNATING CURRENT POWER CIRCUIT

[75] Inventor: Martin C. Oakes, Leeds, England

[73] Assignee: Y. S. Securities Limited, West Yorkshire, England

[21] Appl. No.: 887,547

[22] Filed: Jul. 17, 1986

[30] Foreign Application Priority Data

Jul. 20, 1985 [GB] United Kingdom ..... 8518381

[51] Int. Cl.[4] ..... H01H 85/04

[52] U.S. Cl. ..... 337/158; 200/144 A; 337/163

[58] Field of Search ..... 337/142, 146, 158, 163, 337/186, 199, 202, 224, 273, 279, 281, 282; 200/144 A

[56] References Cited

U.S. PATENT DOCUMENTS

| | | | |
|---|---|---|---|
| 659,671 | 10/1900 | Hewlett . | |
| 685,766 | 11/1901 | Jones . | |
| 1,279,781 | 9/1918 | Steen | 200/144 A |
| 2,279,631 | 4/1942 | McMahon | 337/281 |
| 2,539,261 | 1/1951 | Miller . | |
| 3,587,024 | 6/1971 | Curtis | 337/273 |
| 3,613,040 | 10/1971 | Fluder et al. | 337/282 |
| 3,736,544 | 5/1973 | Fluder | 337/282 |
| 3,921,116 | 11/1975 | Mikulecky | 337/202 |
| 4,301,340 | 11/1981 | Parry | 200/147 |
| 4,301,341 | 11/1981 | Parry | 200/147 |
| 4,315,121 | 2/1982 | Smith | 200/147 |
| 4,346,273 | 8/1982 | Meyer | 200/147 |
| 4,409,447 | 10/1983 | Noeske | 200/148 |
| 4,488,023 | 12/1984 | Matusomoto et al. | 200/147 |
| 4,529,853 | 7/1985 | Bouilliez | 200/147 |
| 4,575,599 | 3/1986 | Arimoto | 200/147 |

FOREIGN PATENT DOCUMENTS

| | | |
|---|---|---|
| 548914 | 4/1932 | Fed. Rep. of Germany . |
| 420619 | 12/1934 | United Kingdom . |
| 455670 | 10/1936 | United Kingdom . |

*Primary Examiner*—Harold Broome

*Attorney, Agent, or Firm*—Bert J. Lewen; Henry Sternberg

[57] ABSTRACT

A fuse for an alternating current power circuit in the medium voltage (3.3 kV to 38 kV) range. The fuse comprises a sealed chamber and a first electrode (41) is mounted within the chamber, the first electrode having a substantially circular periphery (42) and being electrically connected to a first terminal (3) to which a first conductor may be connected. A second electrode (35) is arranged with a conductive surface internally of the chamber, the conductive surface being spaced from the first electrode. A coil (10) is connected in an electrical path between the second electrode (35) and a second terminal (18) to which a second conductor may be connected. An additional electrical contact (44) is mounted within the chamber and in direct electrical connection with the second terminal, and a fusible element (43) directly electrically connects the first electrode (41) and the additional electrical contact (44). An electronegative halogenated medium fills free space within the chamber. The normal current path between the first and second terminals and through the fuse is by way of the first electrode (41), the fusible element (43) and the additional electrical contact (44). The arrangement is such that when the fusible element (43) breaks, the resulting fault current forms an arc between the first electrode (41) and the additional contact (44), one root of the arc subsequently commutates from the additional contact (44) to the second electrode (35 ), the fault current flows through the coil (pb 10) and induces a magnetic field, the magnetic field causes the arc to rotate around the first electrode in the electronegative medium, and the arc is thereby extinguished, so interrupting the fault current.

25 Claims, 12 Drawing Figures

FUSE FOR AN ALTERNATING CURRENT POWER CIRCUIT

This invention relates to an electrical fuse, and particularly to a fuse for an alternating current power circuit in the medium voltage range of 3.3 kV to 38 kV. In order to protect such circuits, various techniques have been used. Within the United Kingdom normal practice has been to employ a current limiting back-up fuse in association with an oil fuse switch. In the United States of America normal practice is to use either a general purpose fuse or a general purpose fuse in series with one or more back-up fuses.

General purpose fuses of the expulsion type are required to break any value of current up to a rated breaking current, and the fuse incorporates a fuse wire element which will melt more or less rapidly according to the fault current level. Due to the heat of the arc produced when the fuse wire melts a high gas pressure is produced which, in theory, creates rapid movement of the dielectric medium which cools, deionises and extinguishes the arc. Although these expulsion type fuses have a pre-arc time current curve that would make them satisfactory for protecting transformer circuits, their short circuit current ratings are at levels sufficiently low severely to restrict their use for these applications.

One known type of back-up fuse is a current limiting cartridge fuse embodying a silver or copper element wound in helicoil form over a porcelain core of star-shaped cross-section, the core being fitted within a porcelain cylinder and the remaining space in the cylinder being filled with sand. In the event of the fuse element melting, the heat generated liquifies the sand and causes a glass-based fulgrite formation to occur around the arc in order to absorb the heat energy of the arc and so extinguish the arc. Such back-up fuses are unsatisfactory for use on their own, as the element can melt below the rated minimum breaking current of the device. This may lead to the fuse being unable to interrupt the circuit and thereby fail catastrophically. A further disadvantage of current limiting fuses occurs due to the long length of small cross-section wire that is necessary for the fuse element, so leading to high $I^2R$ losses and high heat generation. The current ratings of such fuses are thus limited, typically to 100 amps at 15 kV and 120 amps at 12 kV.

It is possible to design a current limiting fuse that can be used as a general purpose fuse, but such fuses will usually exhibit an undesirable pre-arc time current curve and will have limited ability to withstand the transient recovery voltage of the system which they protect.

One method of obtaining satisfactory protection for medium voltage circuits over a full range of fault currents has been to connect a general purpose fuse and a current limiting back-up fuse in series. The two fuses may be mounted in the same envelope, or may be mounted on a common carrier immersed in an oil-filled switch tank or in air. Another method is to fit back-up fuses with fuse strikers capable of tripping associated switches, a so-called fuse switch combination.

Apart from the drawback of requiring two fuses in series or a fuse switch combination in order to perform the required function, another well known problem is that of coordinating the fuse used to protect a distribution transformer so that its pre-arc time current curve closely follows the referred time current curve of a low voltage fuse downstream of the transformer and does not overlap either the referred curve of the low voltage fuse or the time current curve of the protection against feeder over-current that is located upstream of the transformer. It is difficult with conventional fuses to match these curves so as to provide the required close discrimination.

A fuse that bears a superficial resemblance to the fuse that forms the subject of this invention is shown in West German Patent No. 548,914 (DE-A-548914), patented as of Mar. 7, 1930. That patent describes a fuse having an enclosure in which is located a central electrode to which an input conductor may be connected, and an annular electrode spaced from and surrounding the central electrode, the two electrodes being normally connected by a fusible element. The annular electrode is electrically connected to an output conductor through a coil. The enclosure contains air at atmospheric pressure and is closed by a cover plate. During normal operation current flows continuously through the central electrode, the fusible element, the annular electrode and the coil. Should the fusible element melt under fault conditions then an arc will immediately be struck directly between the central electrode and the annular electrode, and the magnetic field generated by the energised coil will cause the arc to rotate immediately and at high speed about the central electrode and eventually to be extinguished. During such movement the ends of the arc move rapidly over both the central and the annular electrode so that these cannot heat to their melting temperature. Once the arc has been established its voltage increases with time in opposition to the supply voltage, and this has the effect of forcing the arc current to zero, at which time the arc is extinguished. The device is suitable for both direct and alternating current and is described as being particularly suitable for low voltage distribution networks and as taking up relatively little space. Indeed, it is essentially a low voltage device as the coil is described as having the effect of a limiting reactor.

DE-A-548914 does not teach how the fuse therein could be used in the context of medium voltage alternating current power circuits, and it would be wholly impractical to attempt to use the fuse in this way. High arc lengths and thus large fuse diameters (e.g. in excess of 1 meter) would be necessary. As arc voltage increases with length, there would thus be very high energy release and a very high increase in air pressure within the enclosure, which may be impossible to contain in a commercially practicable construction.

In addition, the current density in the annular electrode of the fuse of DE-A-548914 will be extremely high, and accordingly there will be excessive heat generation and $I^2R$ losses in normal operation, which entails continuous flow of current in the annular electrode and the coil. These factors render the fuse impractical for use with a medium voltage a.c. power circuit.

The present invention seeks to provide a fuse usable on its own to give complete protection to a medium voltage a.c. power circuit at short circuit current ratings up to and substantially above the upper limit of known expulsion fuses, and capable of being produced with a time current curve that can be closely matched to the referred curve of a low voltage fuse on the downstream side of a transformer with which such a medium voltage fuse may be used.

According to the invention a fuse for an alternating current power circuit in the medium voltage (3.3 kV to 38 kV) range comprises a sealed chamber; a first electrode mounted within the chamber, the first electrode having a substantially circular periphery and being electrically connected to a first terminal to which a first conductor may be connected; a second electrode with a conductive surface internally of the chamber, the conductive surface being spaced from the first electrode; a second terminal to which a second conductor may be connected; a coil connected in an electrical path between the second electrode and the second terminal; an additional electrical contact mounted within the chamber and in direct electrical connection with the second terminal; a fusible element directly electrically connected between the first electrode and the additional electrical contact; and an electronegative halogenated medium filling free space within the chamber; the normal current path between the first and second terminals being by way of the first electrode, the fusible element and the additional electrical contact; and the arrangement being such that when the fusible element breaks, the resulting fault current forms an arc between the first electrode and the additional contact, one root of the arc subsequently commutates from the additional contact to the second electrode, the fault current flows through the coil and induces a magnetic field, the magnetic field causes the arc to rotate around the first electrode in the electronegative medium, and the arc is thereby extinguished, so interrupting the fault current.

In operation, current will normally flow between the first and second terminals by way of the first electrode, the fusible element and the additional electrical contact. In contrast to DE-A-548914, current does not flow continuously through the coil. The fusible element can be made very short, for example about 25 mm in length in comparison with the elements of about 450 mm in length normally used in current limiting fuses, and the normal current path can thus be of very low resistance, so leading to $I^2R$ losses and heat generation that are both very much lower than in conventional current limiting fuses or in the type of fuse shown in DE-A-548914. For example, power losses in fuses of the invention may be as low as 5 watts and 7 watts when passing current of 50 amps and 200 amps respectively under normal operation at 15 kV, compared with a loss of 65 watts at 50 amps for a conventional current limiting fuse (which cannot be made with a 200 amp rating) and, for the type of fuse shown in DE-A-548914, at least 55 and 330 watts. The heat generated at these last-mentioned values is totally unacceptable, and would cause rapid disintegration leading to catastrophic failure of the fuse.

In the event of an overload, the fusible element will melt and the fault current will form an arc between the first electrode and the additional electrical contact. One root of the arc will then commutate from the additional contact to the second electrode and arcing current will thus flow through the coil from the first to the second terminal. A magnetic field will be induced by this current and the field will cause the arc to rotate around the first electrode in the electronegative medium. The arc will be extinguished at or around current zero. It is known, e.g. from U.S. Pat. No. 2,539,261, patented as of Jan. 23, 1951, that sulphur hexafluoride ($SF_6$), which is an electronegative halogenated medium, will assist arc extinction, but the devices shown in that patent will have limited fault-breaking capability, thought to be less than a fault current of several hundred amps. It is also known that an arc may be rotated in an electronegative medium in various constructions of switchgear. However, there has never been a suggestion of utilising this principle in the context of a fuse, and when combined with the other features of the invention it gives the ability to design a fuse having very desirable characteristics that are absent from prior art fuses.

Thus, a fuse according to the invention can handle much higher normal current ratings than is possible with conventional current limiting fuses or a fuse of the type shown in DE-548914, for example 400 amps at 15 kV, and can handle very much higher fault currents than conventional expulsion fuses, for example currents with a peak value of up to 40,000 amps at 15 kV compared to 15,000 amps in a typical expulsion fuse. Accordingly, a fuse may readily be designed to give complete protection to a medium voltage a.c. power circuit by way of a single fuse, removing the need to use general purpose and back-up fuses in series or to use fuse switch combinations. Because fuses of the invention do not operate in a current limiting mode they are substantially surge free, in contrast to conventional current limiting fuses which can cause overvoltages when operating, particularly at reduced system voltages. This advantage stems from the fact that arc extinction, and thus circuit interruption, can only occur at or around current zero.

The time current curve obtainable with a fuse according to the invention can be designed to coordinate closely with the referred curve of any low voltage fuse used downstream of a distribution transformer protected by the fuse. This facility becomes possible because in contrast to conventional current limiting fuses, the fusible element itself plays no part whatsoever in the arc extinguishing process, and it can therefore be designed purely and simply with the required time current curve in mind, the range of design choice being further facilitated by the short length of the fusible element. Thus, the size of the fusible element and its shape, particularly the cross-sectional shape may be designed as required. As the chamber is filled with an electronegative halogenated medium then the environment of the fusible element will be oxygen-free, and accordingly a wide range of choice for the material of the fusible element also becomes available. Fusible elements in earlier current limiting fuses have been made from silver, or occasionally copper, in order to avoid oxidation problems. In the fuse of the invention other material such as tin, aluminium, cadmium, nickel and various alloys may be used, so that design freedom to obtain the required electrical characteristics is enormously widened. Fuses can thus be designed that will reliably and consistently provide any required time current curve and that will exhibit greater tolerance of transformer magnetic inrush currents.

Preferably the design of the coil and the second electrode is such as to induce a difference of from 30° to 80° in phase angle between fault current in the coil and the flux density of the magnetic field, with the current peak occurring before the flux peak.

Significant advantage is gained by delaying the flux peak until after the current peak, so causing the peak angular velocity of the rotating arc to occur after the current peak and thus less than quarter of a cycle before the first current zero after short-circuiting occurs. The arc will thus have high velocity just prior to current zero, and this helps to achieve reliable arc extinction. In addition, arc velocity at peak current will also be kept low, so tending to keep the arc voltage and hence arc energy at low values. The phase angle difference is more preferably from 45° to 65°. High peak normalised flux density of the magnetic field induced by the short circuit current also helps arc extinction, and preferably this density at the arc centre is from 50 to 100 microteslars/amp, more desirably from 70 to 90 microteslars-/amp.

It has been found that it is advantageous to reduce rotation of the arc during any part of the cycle in which the absolute value of the current is increasing. Arc rotation during this period unnecessarily increases arc length, arc voltage, arc energy and gas pressure within the housing, making the arc more difficult to extinguish and leading to a requirement for stronger pressure vessels. In the fuse of the invention there is in any case some delay before the arc root commutates from the additional contact to the second electrode, and thus some delay before arc rotation commences, so assisting in obtaining the desired effect. It may be desirable, however, to shape the additional contact so that on arcing, that root of the arc which is in contact with the additional contact travels over a path on the surface of the contact before commutating to the second electrode. The delay in commutation is thus increased. In one preferred construction of this nature the additional contact has an annular rim and is axially spaced from but substantially coaxial with the first electrode, the annular rim forming the path for the root of the arc.

Control may also be effected by appropriate relative positioning of the first and second electrodes, it being preferred that the distance between the two electrodes is short, in order again to reduce arc length and energy. Distances of from 6 mm to 22 mm are presently preferred, the distance increasing in the preferred range as the working voltage for which the fuse is designed increases from 3.3 to 38 kV.

In many embodiments of fuse according to the invention the coil will radially surround the chamber in which the first electrode is mounted, and may also radially surround the first electrode itself. The second electrode may also radially surround the first electrode.

The radial mid-planes of the coil and of the circumference of the first electrode are preferably substantially coincident as in this way the arc will lie within the region of highest magnetic flux, so helping to hold the arc in that optimum plane and again assisting in keeping the arc as short and controlled as possible.

It is possible for the interrupter to be manufactured sufficiently cheaply for it to be used as a wholly disposable fuse in like manner to conventional current limiting fuses. Alternatively, however, the interrupter may be made of two-part construction, a disposable first part that includes the first and second electrodes, the fusible element and the additional contact; and a retainable housing part that incorporates the coil. In a preferred two-part construction the housing part is made from insulating material having the coil embedded therein.

The fuse is designed to give protection to a single phase only of a multi-phase supply. Practice in the United States is generally to interrupt only one phase of a supply if a fault occurs on that phase, but to maintain the other phases. In the United Kingdom and elsewhere it is more common to interrupt all phases in response to a fault condition occurring on any one phase. A fuse according to the invention may be designed to include means responsive to fault current passing between the first and second terminals to produce an output signal, which signal may be mechanical or electrical. That signal may then be used to initiate mechanical rupture of the fusible element in a fuse for each other phase of the supply, so that all phases are interrupted substantially simultaneously.

The invention will be better understood from the following description of embodiments of circuit interrupters in accordance therewith, given with reference to the accompanying drawings in which.

FIGS. 3 to 12 each show a longitudinal cross-section through a further embodiment of interrupter.

Figure 1:
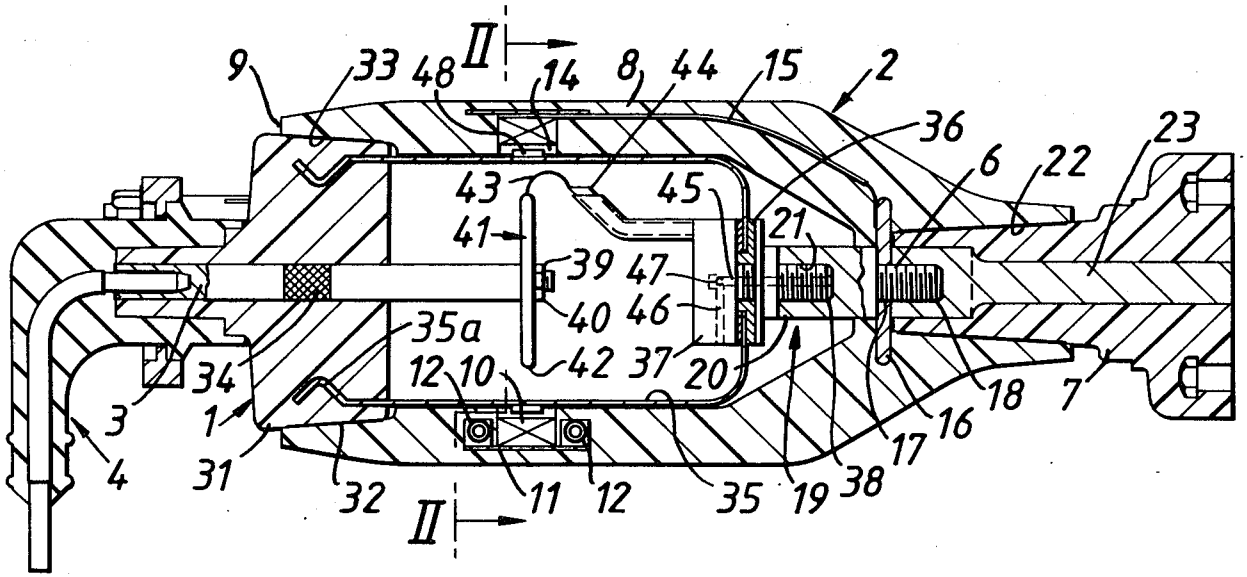
FIG. 1 is a longitudinal cross-section through a first form of interrupter.
Figure 2:
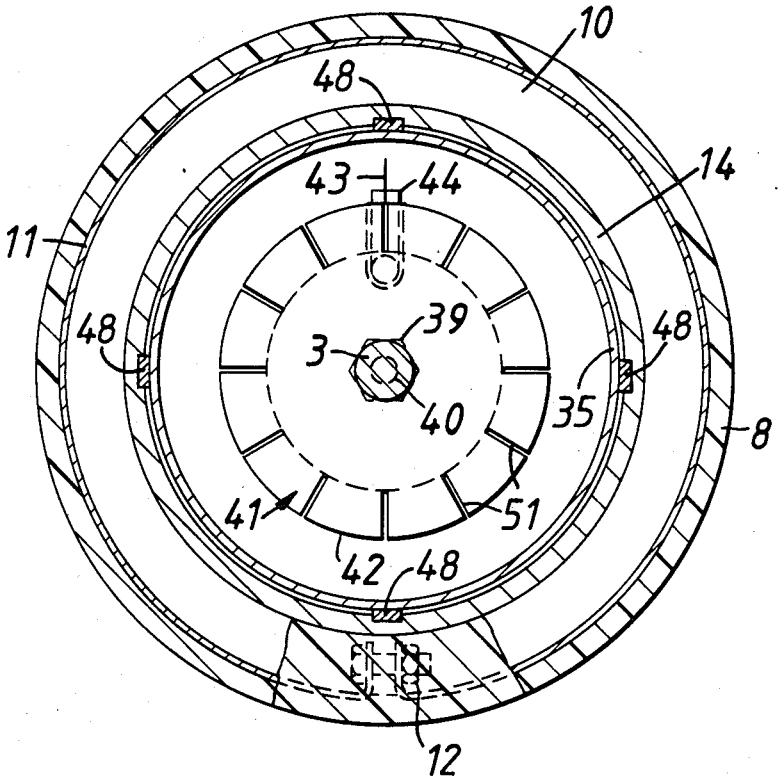
FIG. 2 is a cross-section on the line II—II of FIG. 1.

Referring now to FIGS. 1 and 2 of the drawings these show a fuse for a medium voltage a.c. power circuit, the fuse being formed in two parts shown generally as 1 and 2 respectively. The first part incorporates a first terminal 3 capable of connection by any suitable connector 4 to an electrical outlet such as a cable. The second part 2 incorporates a second terminal 6 capable of being connected to any appropriate piece of electrical equipment for example a transformer or switchgear having a bushing 7. The second part of the fuse comprises a housing 8 which is open at one end 9 of the housing. The housing may conveniently be cast or moulded from any suitable insulating material, such as a flexible or rigid resin or rubber.

A coil 10 retained by a band 11 and clamping bolts 12 is cast or moulded in situ with the material of the housing and is thus embedded in insulating material. One end of the coil winding is electrically connected to a coil former in the form of a conductive ring 14, which also forms a shorted innermost turn of the coil. The other end of the coil is electrically connected by a conductor 15 to a conductive disc 16 which is again cast or moulded in situ in the housing 8. The disc 16 has an internally threaded hole 17 into which an externally threaded stem 18 (forming the terminal 6) of a connector 19 is secured, the connector also including a boss 20 projecting towards the open end 9 of the housing. The boss has an internally threaded bore 21. The stem 18 or terminal 6 projects into a tapered opening 22 into which the bushing 7 may be inserted, a conductor 23 within the bushing having an internally threaded bore which may be engaged with the terminal 6.

The first part 1 of the fuse comprises a carrier 31, again cast or moulded from any suitable insulating material, the carrier having a tapered outer surface 32 which may be received in a tapered section 33 at the open end of the housing 8. If the material of either the housing 8 or the carrier 31 is flexible then a good seal can be effected between the two; if both materials are rigid then it will be desirable to include one or more sealing rings at the interface between the two parts. The first terminal 3 extends through the carrier 31 and is cast or moulded in situ, the terminal having a roughened section 34 that keys into the insulating material in order to secure the terminal against movement relative to the carrier and to provide a gas-tight seal. A copper cylinder 35 has a shaped end thereof embedded in the carrier 31. The opposite end of the cylinder is turned inwardly and the resulting annulus is secured within an annular support 36 of insulating material carried by a mounting block 37 of electrically conductive material, for example aluminium, copper or brass. The mounting block has an externally threaded spigot 38 engageable within the bore 21 of the boss 20. A lock nut 39 threaded onto a threaded end 40 of terminal 3 holds a first electrode 41 in position on, and in electrical contact with, the terminal 3. The first electrode 41 is a disc having a substantially circular periphery 42 and a fusible element 43 electrically connects a point on the electrode (conveniently but not necessarily on the periphery thereof) to an additional electrical contact 44 supported from and electrically connected to the mounting block 37. The circumference of the electrode 41 is formed with a plurality of radially inwardly extending cuts such as 51, so dividing it into a number of petal-like regions. The copper cylinder 35 forms a second electrode spaced from and radially surrounding the first electrode 41. The spacing between the two should be kept as short as possible, and is preferably in the range of from 6 mm to 22 mm.

The mounting block 37 is formed with a passageway having an axial section 45 opening from the end of the spigot 38 and a radial section 46 opening into the chamber formed within the copper cylinder. A ball valve 47 is located adjacent to the junction of the passageway sections. By use of a suitable implement the ball valve may be lifted and held off its seat at the inner end of passageway section 45 while a vacuum is drawn in the chamber, and the chamber may then be pressurised by way of the passageway with an electronegative halogenated medium, the over-pressure in the chamber holding the ball valve on its seating after pressurisation. The preferred medium is sulphur hexafluoride ($SF_6$), but other halogenated gases (such as carbon tetrafluoride), liquids and liquid/gas mixtures are possible.

The fuse is shown in assembled form, but it will be appreciated that the parts may be separated by unscrewing the spigot 38 from the bore 21 and axially withdrawing the part 1 from the housing formed by the part 2. When assembled as shown in FIGS. 1 and 2, however, the arrangement is such that spring fingers 48 carried by the shorted ring 14 will engage the outer surface of the copper cylinder 35 and electrically connect the cylinder to the ring 14, and that the radial mid-planes of the coil 10, the ring 14 and the circumference 42 of electrode 41 are substantially coincident.

In operation, when the fuse is assembled as shown, a current path is established between the terminals 3 and 6 by way of the first electrode 41, the fusible element 43, the contact 44, the mounting block 37 and the connector 19. This current path is maintained during normal current conditions and presents very little resistance to the current, so that the $I^2R$ losses through the fuse are low, and the heat generated in the fuse is also low.

If a current overload occurs, then the fusible element 43 will melt over a time period dependent on the characteristics of the link and the magnitude of the overload current. Once the link has melted an arc will be struck between the circumference 42 of the electrode 41 and the contact 44, and the arc root on contact 44 will thereafter commutate onto the cylinder 35 forming the second electrode. Such commutation is assisted by the relative positioning of the parts, particularly by the respective shortest distances between circumference 42 of the electrode 41 and the contact 44 and between that circumference and the cylinder 35, and by the magnetic loop forces induced by the current flowing to and in the arc, which will tend to drive the arc radially of the disc 41 and away from the contact 44. When the arc has commutated onto the copper cylinder 35, arcing current will flow radially through the cylinder wall to the ring 14, and thence through the coil 10, the connector 15 and the disc 16 to the conductor 6. The current flowing in the coil will induce a circulating current around the circumference of the shorted ring 14 and cylinder 35 which is out of phase with the main current, and a resultant magnetic field will be created and will be maintained during and beyond the whole of the current cycle. The flux will cause the arc to rotate around the electrode 41 in the $SF_6$ or other electronegative medium and the arc will be extinguished at or around a current zero, so breaking the circuit.

As the magnetic field has components resulting from the current in the cylinder 35 and the ring 14, as well as from the coil 10, the total magnetic flux will be out of phase with the current in the coil, the current peak occurring before the flux peak, and the phase difference preferably being from 45° to 65°. As the angular velocity of the arc is closely related to peak flux, this phase difference will mean that the arc has high velocity just prior to current zero, so assisting reliable extinction of the arc. Arranging the radial mid-plane of the coil coincident with the radial mid-plane of the circumference of the electrode 41 will assist in holding the arc in that plane, which is the region of maximum magnetic flux, so keeping the arc as short as possible, thus ensuring minimum arc energy and assisting in giving the arc high angular velocity. A flux peak normalised density at the arc center of from 70 to 90 microteslars/amp is preferred.

The petal-like division of the first electrode is not essential, but may further help to control current in that electrode to a radial flow path, so assisting maintenance of the arc radially between the electrodes. As the arc rotates between the electrodes it will form a spiral due to the different diameters of the electrodes, but by keeping the ratio between the electrode diameters as small as possible this effect may be reduced. This also assists in producing a short, well-controlled arc in the plane of maximum flux density, the energy of the arc being low and its angular velocity being high in order to facilitate extinction at or around the first current zero.

It will be appreciated that a range of fuses may be manufactured, each having a fusible element 43 with a different characteristic chosen according to the requirements of the particular fuse. Thus, the material and cross-sectional area of the fusible element 43 may be varied as required, although it is preferred to keep the element as short as possible in order to reduce $I^2R$ losses and heat generation. It will be understood that the invention is not limited to the provision of a single fusible element 43, and one particularly effective way of providing a range of fuses may be to multiply the numbers of fusible elements 43 and contacts 44 that are connected in parallel between the electrode 41 and the mounting block 37. For example, each such fusible element may be rated at 50 amps, so that a 200 amp fuse would include four such elements and associated contacts connected in parallel. If several arcs are struck simultaneously on melting of the elements of such a fuse then the arcs will coalesce into a single arc for rotation and extinction. Proper selection of the fusible element will help to enable the fuse to be manufactured with a time current curve designed to match the referred curve of any low voltage fuse with which the fuse is to be associated.

Figure 3:
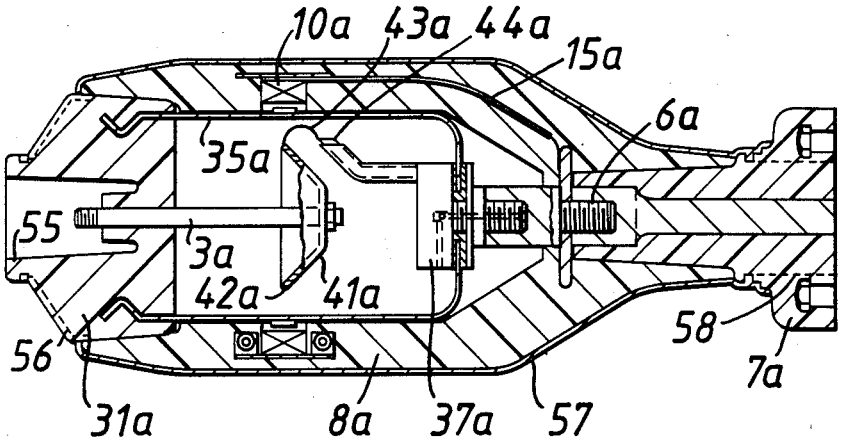

FIG. 3 shows a shielded two-part fuse similar to that shown in FIG. 1 and corresponding parts are given the same reference numerals with the suffix a. The fuse differs from that shown in FIG. 1 by the provision of a different type of international standard connector 55 formed integrally into the carrier 31*a*, which carrier also includes screening 56. The external surface of the housing 8*a* is coated with a conductive screening material 57 capable of being connected to ground. Screening 58 is also incorporated in the bushing 7*a*. The screening thus creates an electrical shield for the external surface of the fuses, and when connected to ground makes that external surface safe to touch even though the conductors may be live. Similar shielding may be incorporated in any of the embodiments shown.

The electrode 41*a* is shown of frusto-conical form and it extends back over the terminal 3*a* away from the contact 44*a*. This means that the net magnetic loop forces are such that the arc is more closely constrained to a radial plane, and may again assist arc control.

Figure 4:
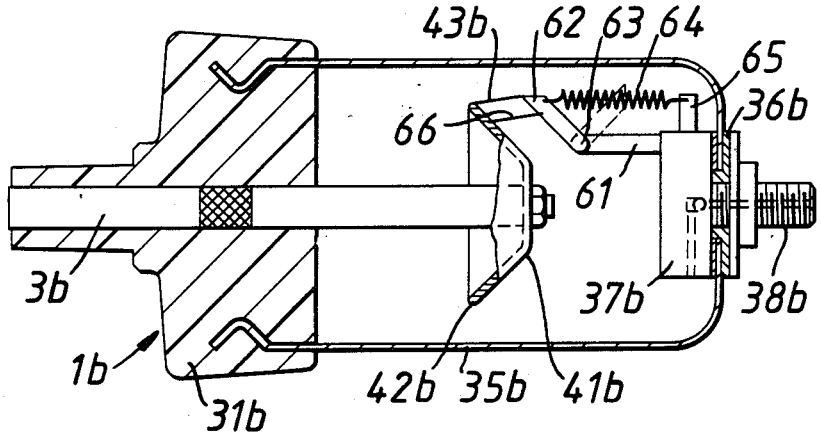

FIG. 4 shows an alternative first part 1*b* of a fuse which may be substituted for the part 1 shown in FIG. 1. Parts common to the fuse of FIG. 1 are shown with the same reference numerals with the suffix b. In this embodiment the contact 44 of FIG. 1, rather than being an integral rigid structure comprises a rigid section 61 secured to the mounting block 37*b* and a movable section 62 pivotally mounted at 63 on the rigid section 61. A tension spring 64 acts between the movable section 62 and a support 65 on the mounting block 37*b*, and the movable contact is held against the action of the spring by the fusible element 43*b* and/or by a parallel strain wire 66.

When the fusible element 43*b* melts, current diverts to the strain wire 66, which is thus weakened or may also melt, and the movable section 62 pivots to the position shown in broken lines, under the action of spring 64. In so doing the tip of the movable section 62 will pass close to the copper cylinder 35*b* and the arc maintained between the electrode 41*b* and the movable contact 62 will commutate onto the copper cylinder 35*b* and will stabilize in the midplane of the ring 14. This arrangement will particularly improve commutation at lower fault currents.

Figure 5:
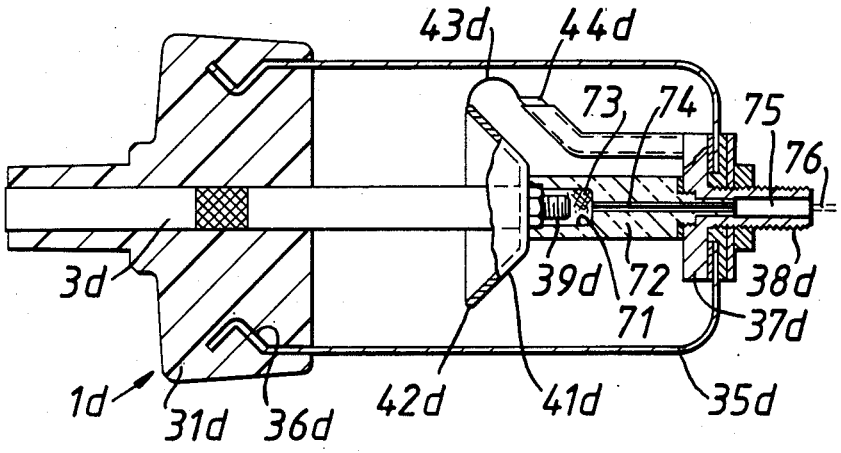
Figure 6:
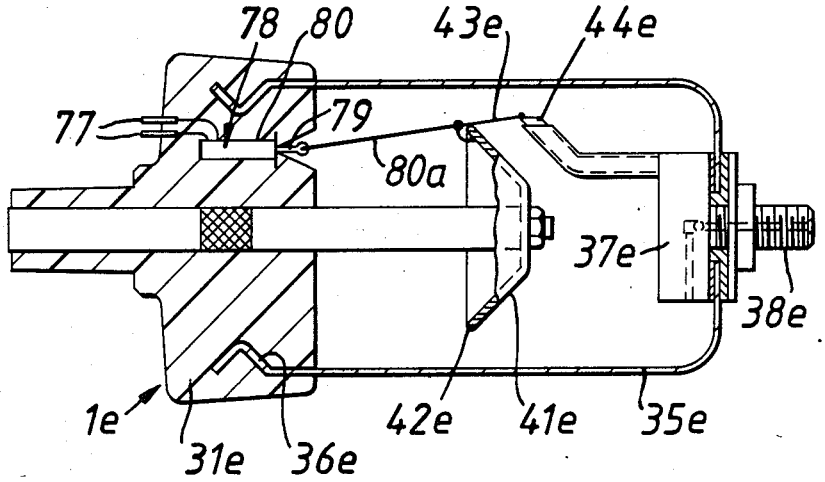
Figure 7:
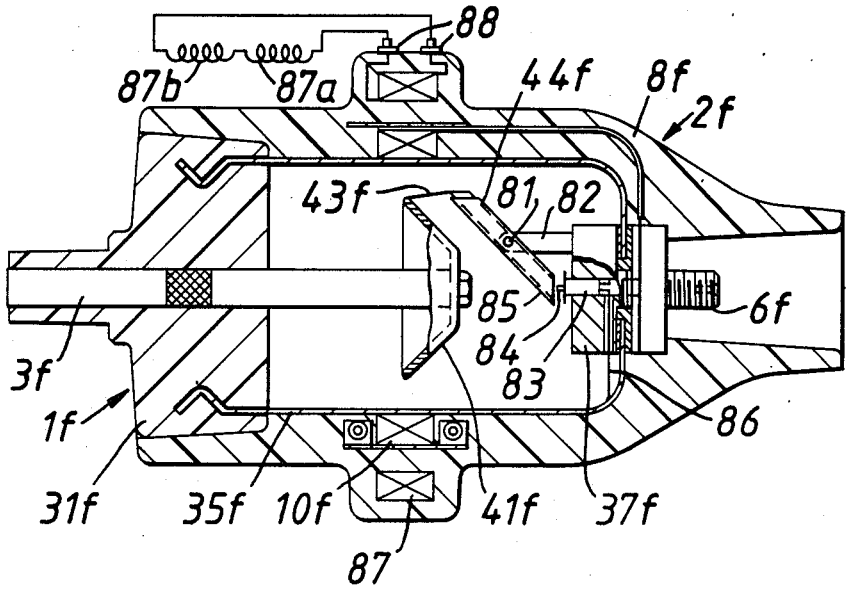

In the protection of a three-phase supply there is often a requirement that all three phases be interrupted should a fault occur on one phase that causes rupture of the fusible element of that phase, and FIGS. 5 to 7 illustrate embodiments that enable this to be achieved.

FIG. 5 shows a first fuse part 1*d* similar to the first fuse part 1 shown in FIG. 1, and identifying similar parts by the same reference numerals as in FIG. 1 with the suffix d. In this embodiment the threaded end 39*d* of the terminal 3*d* is engaged in a recess 71 in an insulating member 72, the recess thereafter being filled with an electrically conductive composition 73 to provide contact between the threaded end 39*d* and a thin wire 74 leading to a chemical actuator or pyrotechnic device 75. In the event of an over-current a wire in the pyrotechnic device together with wire 74 will burn out before the fusible link 43*d* melts, and a resultant explosive effect within the device will cause a striker 76 to be forcibly driven out of the actuator. The striker may, either directly or through an appropriate linkage, operate an external trip bar designed to initiate the opening of mechanical switches on the other two phases of the supply.

There are many methods by which an over-current can be sensed and an electrical signal generated in response thereto. FIG. 6 shows one way in which the first fuse part 1*e* can be modified in order to utilise a low voltage generated in response to an over-current. The part is designed to replace the fuse part 1 shown in FIG. 1, and similar parts are given the same reference numerals as in FIG. 1 with the suffix e. The over-current sensing means for each of the three phases is designed so that when an over-current is detected a low voltage signal is applied to terminals 77 of each of the other two phases. These low voltage terminals are connected to a pyrotechnic device or other chemical actuator 78, the device being such that on application of a voltage thereto a plunger 79 is retracted within a cylinder 80 of the device. The plunger is connected by way of a strong insulated rope 80*a*, for example of an aramid fibre, such as Kevlar TM, to the fusible element 43*e*. Accordingly, on retraction of the plunger 79 the fusible element 43*e* will be mechanically ruptured, an arc will strike to the contact 44*e*, will commutate to the copper cylinder 35*e* and will be rotated and then extinguished as already described.

FIG. 7 shows a further embodiment of fuse capable both of generating an over-current signal for tripping fuses on other phases of an electrical supply and of being tripped in response to an over-current signal on the fuse of another phase. Corresponding parts are given the same reference numerals as in FIG. 1 with the suffix f, and it will be seen that the fuse is again a two part fuse comprising parts 1*f* and 2*f*. In this embodiment the fusible link 43*f* extends from the circumference of the electrode 41*f* to the contact 44*f* which is pivotally mounted at 81 on a support 82 secured to the mounting block 37*f*. The mounting block incorporates a pyrotechnic device or chemical actuator 83 having a striker 84 which when expelled from the device can engage an end 85 of the contact 44*f* with sufficient force to pivot the contact and mechanically break the fusible link 43*f*. One terminal of the actuator 83 is electrically connected by conductor 86 to the copper cylinder 35*f*, and the other terminal of the actuator is connected to mounting block 37*f*. The housing 8*f* of the second part of the fuse incorporates a secondary coil 87 that is normally at or near to earth potential and that radially surrounds the coil 10 and is spaced therefrom by housing material so that the coils 10 and 87 together effectively form an air core transformer. The secondary coils 87, 87*a*, 87*b* of the fuses of all three phases of the three phase supply are electrically connected in series by conductors joining terminals such as 88 of each phase, the terminals extending through the housing 8*f* and being electrically connected to opposite ends of the respective coil 87.

It will be seen that in normal operation each fuse provides a current path for its respective phase by way of the first terminal 3*f*, the electrode 41*f*, fusible element 43*f*, contact 44*f*, support 82 and mounting block 37*f* to the second terminal 6*f*. If an over-current occurs on any one phase and the fusible element 43*f* of that phase melts, the resulting arc stabilises between the electrode 41*f* and the copper cylinder 35*f* in the axial mid-plane of the coil 10*f* and the magnetic field induced by the current in the coil 10*f* causes rotation and subsequent extinction of the arc at a current zero. The current passing through the coil 10*f* will also induce current in the secondary coil 87 which will flow through the secondary coils 87*c*, 87*b* of the fuses of the other two phases. In each other phase the current flowing in the secondary coil will induce a low voltage in the main coil 10*f* of the respective fuse, which voltage will be applied to the chemical actuator 83 by way of the copper tube 35*f* and the conductor 86. The voltage will be sufficient to cause operation of the actuator, so that the striker 84 will pivot the contact 44*f* to break the fusible element 43*f* of the respective phase. The main current path of each phase will thus be broken and an arc will therefore be struck in each phase which will be caused to rotate and subsequently will be extinguished in the same way as for the phase in which the initial fault occurred.

Figure 8:
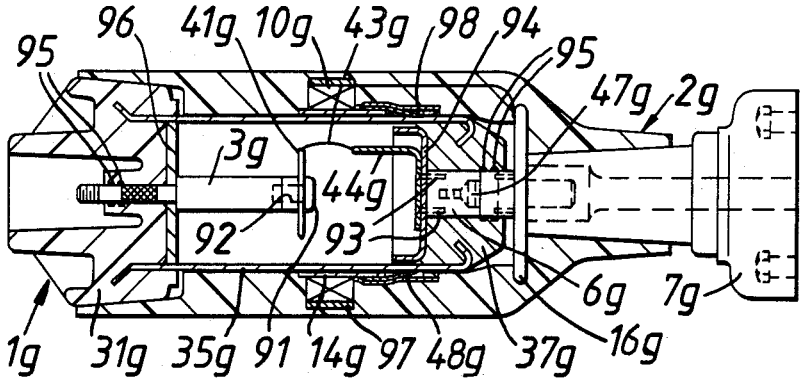

FIG. 8 shows a further embodiment of the basic fuse, in many respects similar to that of FIG. 1. Corresponding parts are given the same reference numerals as in FIG. 1 with the suffix g. The fuse is a two-part fuse comprising parts 1*g* and 2*g*. The first part of the fuse differs from that shown in FIG. 1 in that the first electrode 41*g* is secured to the first terminal 3*g* by a bolt 91 threaded into a tapped bore 92 at the inner end of that terminal. In addition, the contact 44*g* is of different shape to that shown in FIG. 1 and is secured by screws 93 to a mounting block 37*g* of insulating rather than conductive material. A conductive terminal 6*g* is cast or moulded in situ to extend through the mounting block, and has a threaded end that passes through ring 16*g*. The screws 93 also secure a heat shield 94 of any suitable metal or other material to the mounting block 37*g*. Sealing around the terminals 3*g* and 6*g* where they pass through the respective insulating parts 1*g* and 37*g* is improved by sealing rings 95 between the respective parts. A heat shield 96 of electrically non-conductive material is held onto the internal resin surface of the carrier 31*g*, to protect the resin from the heat generated by the arc. The shield may be of any suitable heat-resistant material, such as an alumina based ceramic or polytetrafluoroethylene. The passage and valve 47*g* for evacuating and pressurising the chamber within cylinder 35*g* is simplified.

The part 2*g* of the fuse differs from that shown in FIG. 1 principally in the form of the contact fingers 48*g* disposed around the circumference of the housing 2*g* and resiliently biased inwardly through an opening 98 in that housing. The coil is secured by a strap 97 and buckle.

In one specific embodiment of the fuse of FIG. 8, rated for 200 amps at 15 kV, the fusible link 43*g* had a resistance such as to generate 7 watts at the maximum rated current. The radial gap between the electrode 41*g* and cylinder 35*g* was 17 mm and the coil 10*g* had ten turns. Under fault conditions the peak normalised flux density of the magnetic field at the arc center was 90 microteslars/amp and the phase difference between the peak short-circuit current and the magnetic flux was 60°. The fuse was found to be capable of safely interrupting fault current having a peak value of 33,000 amps.

Figure 9:
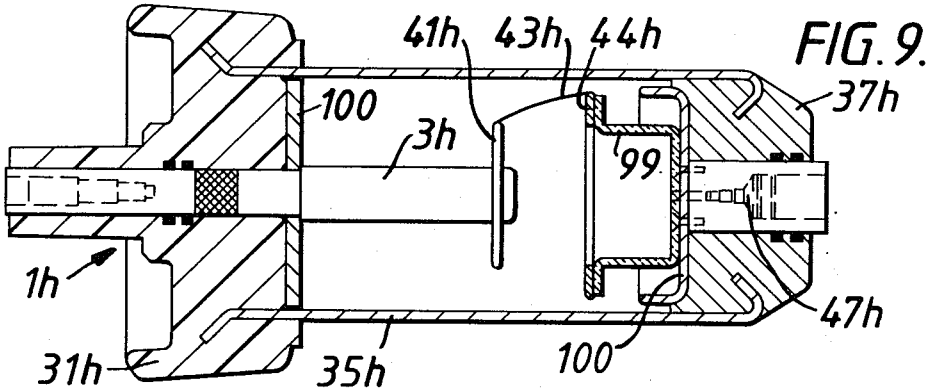

FIG. 9 shows the first part 1*h* of a fuse similar to that shown in FIG. 8, and that can be used in conjunction with a second part identical to the part 2*g* of FIG. 8. Corresponding parts are given the same reference numerals as in FIG. 1, with the suffix h. In this embodiment the contact 44*h* is an annular ring supported by a conductive member 99. When the fusible element 43*h* melts an arc will strike between the electrode 41*h* and the annular contact 44*h* and the respective roots of the arc will progress slowly around the electrode 41*h* and the ring 44*h* before the arc commutates from ring 44*h* to the conductive cylinder 35*h*. In addition to the effect of inherent magnetic loop forces this progression occurs because the arc roots will tend to move towards cooler metal, and the arc movement has the advantage that erosion of the electrode 41*h* and the contact 44*h* are reduced very significantly in comparison to the erosion that would occur if an arc were to be left burning between small unchanged regions of the respective members for a similar length of time. The arc may thus be allowed to dwell longer before it commutates onto the cylinder 35*h*. The arc can be held between the electrode 41*h* and the contact 44*h* during any part of the current cycle in which the absolute value of the current is increasing, so avoiding high speed arc rotation between the electrodes 41*h* and 35*h* and thus reducing arc voltage, arc energy and gas pressure within the chamber. The fuse shown in FIG. 9 also incorporates heat shields 100 of suitable materials.

Figure 10:
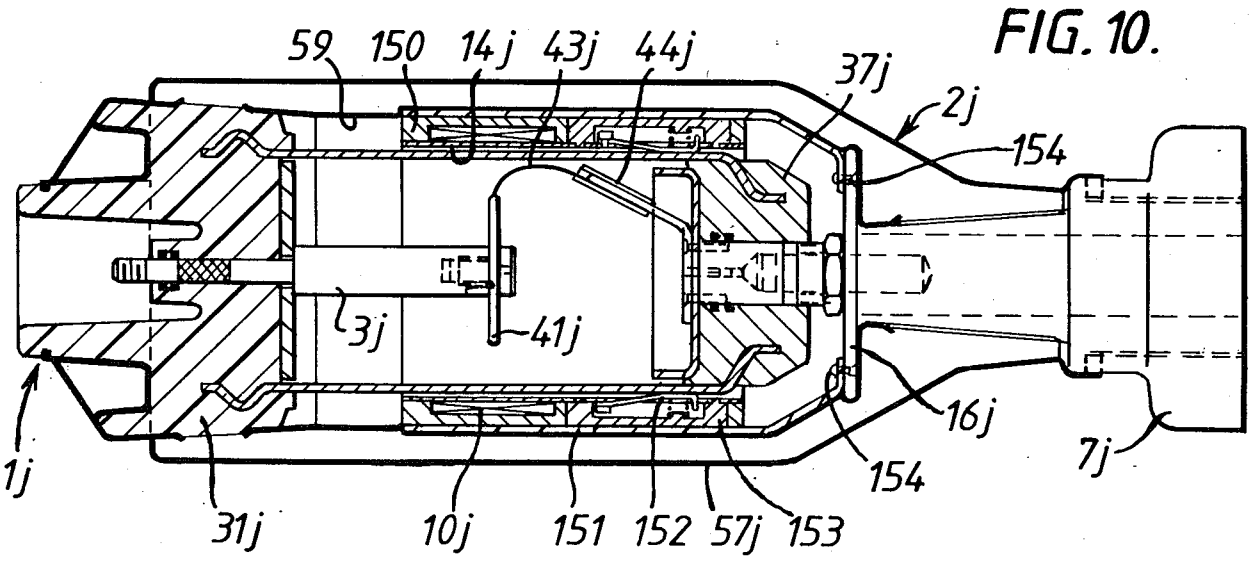

FIG. 10 shows a shielded fuse similar to that shown in FIG. 8. Again, corresponding parts are given the same reference as in FIG. 1, but with the suffix j. It will be seen that the fuse differs from that of FIG. 8 in that external surfaces of the housing 8*j* and the carrier 31*j* are coated with electrically conductive screening material 57*j* which, in use, is connected to ground. In addition, the inner surface of the housing 8*j* is also coated with electrically conductive material 59, in order to maintain that surface at a desired potential and remove the possibility of electrical stress in the air gap between the housing 8*j* and the fuse part 1*j*.

FIG. 10 also illustrates a modified construction for the coil 10*j*, as an alternative to moulding or casting the coil in situ in the material used for the housing 8*j*. In this embodiment the coil is cast or moulded into a block 150 of insulating material which is bonded to a sleeve 151 of electrically conductive material. One end of the coil winding is electrically connected to the sleeve 151, the other end of the winding is electrically connected to a ring 14*j* that constitutes a coil former and a shorted innermost turn of the coil. The ring 14*j* is electrically connected to fingers 152 that engage the cylinder 35*j* of the fuse part 1*j* when inserted into the housing. A carrier 153 for the fingers 152 is also bonded to the sleeve 151.

An inner end of the sleeve 151 is secured by bolts, rivets, spot welding or other suitable means 154 to conductive disc 16*j*. The assembly of sleeve 151, coil 10*j* and disc 16*j* can be formed separately from the housing 8*j* and inserted into position within the housing once this has been cast or moulded as required.

The embodiments shown in FIGS. 1 to 10 are all constructions wherein the coil is in close axial proximity to the first electrode, but this is not an essential requirement.

Figure 11:
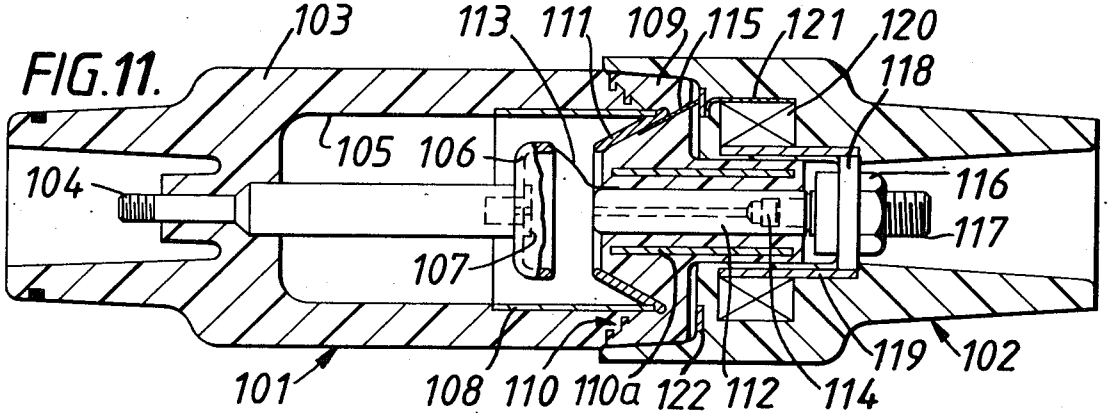

FIG. 11 shows a further embodiment of fuse comprising a first part 101 and a second part 102. The first part 101 includes a first housing section 103 of cast insulating material with a first terminal 104 cast or moulded in situ. The terminal extends into the interior of a chamber 105 formed within the housing 103 and a first electrode 106 is secured to the end of the terminal by a bolt 107 extended into a tapped bore in the terminal. A sleeve 108 that may be conductive or insulating, is also cast or moulded in situ in the housing 103. An open end of the housing is closed by a further body 109 cast or moulded from insulating resin material, the body 109 being held on the part 103 by interlocking tongue and groove formations 110. The body 109 incorporates a frusto-conical second electrode 111. A second terminal 112 extends through the center of the body 109, and its inner end is connected to the electrode 106 by a fusible element 113. The terminal 112 has a central bore and a valve arrangement 114 by way of which the interior of the assembly may be evacuated and then pressurised with an electronegative medium. Contact fingers 115 are in electrical connection with the second electrode 111 and project from the insulating material of the body 109. A cylinder 110*a* of ferromagnetic material is encapsulated in the body 109.

The first part 101 may be received into a second part of the fuse 102 as shown in the Figure and secured in position by a nut 116 screwed onto a threaded end 117 of the terminal 112, the threaded end extending through a conductive disc 118. That conductive disc is electrically connected by a shorted conductive ring 119 to one end of a coil 120, the other end of which is connected by connector 121 to a conductive ring 122 exposed on one surface of the part 102. When assembled, it will be seen that the contacts 115 make electrical contact with the ring 122.

It will be evident that the fuse operates in a similar way to that of the fuse of FIG. 1. In normal operation current flow will be through terminal 104, electrode 106, fusible element 113, and terminal 112. In the event of an overload the fusible element 113 will melt and an arc will be struck between electrode 106 and terminal 112, one root of the arc then commutating from terminal 112 onto the second electrode 111. Current will then flow through the coil 120 to the terminal 112 so generating a magnetic field with lines of force passing through the gap between electrodes 106 and 111. Flux density in this region is improved by the presence of the ferromagnetic cylinder 110*a*. The arc will rotate in the electronegative medium, and it will become extinguished at or around current zero.

Each of the fuses illustrated in FIGS. 1 to 11 is a two-part assembly, comprising a housing incorporating a coil, and a disposable unit fitting into the housing and incorporating a fusible element. Each assembly shows a housing designed to receive a single disposable unit, but for a three phase supply it is possible to provide a housing providing three chambers each with an associated coil, with three disposable units, one for each phase, one unit fitted into each chamber.

Figure 12:
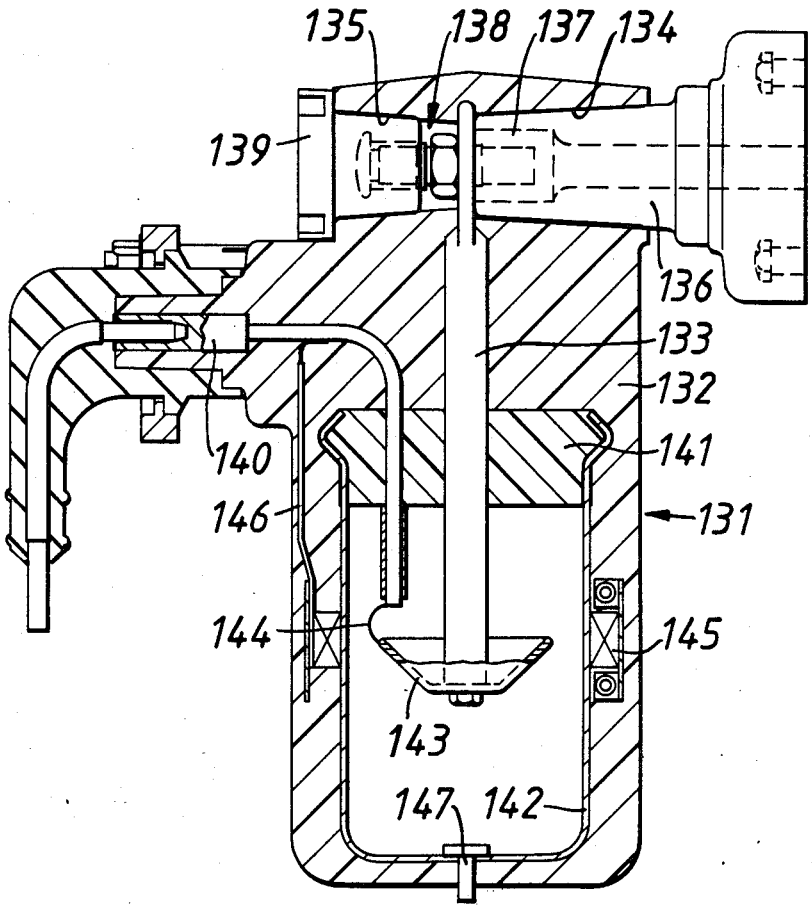

FIGS. 1 to 11 have illustrated two-part fuse assemblies wherein the input and output conductors are coaxial and the fuse is intended to be mounted horizontally. This arrangement is not essential and FIG. 12 shows a possible one-part arrangement wherein a fuse shown generally as 131 is designed for mounting with its axis vertical. The fuse comprises a cast body 132 of insulating material having a first terminal 133 which is exposed at the junction between two tapered openings 134, 135 at an upper part of the body. The opening 134 can receive a bushing 136, for example of a transformer, and a conductor 137 within that bushing can be mechanically and electrically connected to the terminal 133 by a bolt and nut assembly 138 in the opening 135, the opening being subsequently closed by a plug 139. A second terminal 140 is also cast in situ in the body 132, as is a support 141 for a hollow copper cylinder 142. The conductor 133 passes through the support 141 into the cylinder and terminates in an electrode 143 connected by a fusible element 144 to a free end of the terminal 140. A coil 145 has one end of its winding connected to the copper cylinder 142 and the other end of its winding connected by a conductor 146 to the terminal 140. A connector 147 includes passages whereby the interior of the cylinder 142 may be evacuated and pressurised, and extends through the housing 132. It will be appreciated that this arrangement will operate in similar manner to that described with reference to FIG. 1.

A number of possible embodiments of two-part fuses have been shown in FIGS. 1 to 11, and it will be understood that any of these constructions may be modified to a one-part structure. Similarly, the one-part structure of FIG. 12 can be modified to a two-part structure. It will be appreciated that there are many modifications that can be made and many other configurations that could be manufactured. The shape of the center electrode 41 may be varied as required, with disc-shaped, frusto-conical or other forms of electrode being used in any of the embodiments. A heat shield such as shield 99 in FIG. 8 may be incorporated into any of the fuses shown. Other modifications will be apparent to those skilled in the art.

I claim:

1. A fuse for an alternating current power circuit in the voltage range of 3.3 kV to 38 kV, the fuse comprising a sealed chamber; a first electrode mounted within the chamber, the first electrode having a substantially circular periphery and being electrically connected to a first terminal to which a first conductor may be connected; a second electrode with a conductive surface internally of the chamber, the conductive surface being spaced from the first electrode; a second terminal to which a second conductor may be connected; a coil connected in an electrical path between the second electrode and the second terminal; an additional electrical contact mounted within the chamber and in direct electrical connection with the second terminal; a fusible element directly electrically connected between the first electrode and the additional electrical contact, and an electronegative halogenated medium filling free space within the chamber; the normal current path between the first and second terminals being by way of the first electrode, the fusible element and the additional electrical contact; and the arrangement being such that when the fusible element breaks, the resulting fault current forms an arc between the first electrode and the additional contact, one root of the arc subsequently commutates from the additional contact to the second electrode, the fault current flows through the coil and induces a magnetic field, the magnetic field causes the arc to rotate around the first electrode in the electronegative medium, and the arc is thereby extinguished, so interrupting the fault current.

2. A fuse as claimed in claim 1 in which the design of the coil and the second electrode is such as to induce a difference of from 30° to 80° in phase angle between fault current in the coil and the flux density of the magnetic field, with the current peak occurring before the flux peak.

3. A fuse as claimed in claim 2 in which the phase angle difference is from 45° to 65°.

4. A fuse as claimed in claim 1 in which the peak normalised flux density of the magnetic field at the arc center is from 50 to 100 microteslars/amp.

5. A fuse as claimed in claim 1 in which the peak normalised flux density of the magnetic field at the arc center is from 70 to 90 microteslars/amp.

6. A fuse as claimed in claim 1 in which the coil is moulded or cast in situ in electrically insulating material that forms part of a casing of the fuse.

7. A fuse as claimed in claim 1 in which the coil radially surrounds the chamber in which the first electrode is mounted, and the radial mid-planes of the coil and of the circumference of the first electrode are substantially coincident.

8. A fuse as claimed in claim 1 in which the chamber has a cylindrical wall of electrically conductive material and the wall forms the second electrode.

9. A fuse as claimed in claim 1 in which opposite ends of the fuse each comprise a connector section of insulating material, each connector section having a frustoconical opening tapering inwardly from an open end to a closed end, and the first and second terminals each extending into the closed end of a respective one of the openings and lying coaxially with its respective opening.

10. A fuse as claimed in claim 8 in which the cylindrical wall of the chamber is supported by a mounting block of electrically insulating material at a first axial end of the chamber, the first terminal extends through the mounting block from an outer end externally of the chamber to an inner end internally of the chamber and the first electrode is secured to the inner end of the first terminal.

11. A fuse as claimed in claim 8 in which the cylindrical wall of the chamber is supported by a second mounting block of electrically insulating material at a second axial end of the chamber, the second terminal extends through the second mounting block from an outer end externally of the chamber to an inner end internally of the chamber and the additional electrical contact is secured to the inner end of the second terminal.

12. A fuse as claimed in claim 1 in which the additional electrical contact is shaped so that after the fusible element breaks, that root of the arc which is in contact with the additional contact travels over a path on the surface of the additional contact before commutating to the second electrode.

13. A fuse as claimed in claim 12 in which the additional contact has an annular rim and is axially spaced from but substantially coaxial with the first electrode, the annular rim forming the path for the root of the arc.

14. A fuse as claimed in claim 1 in which the additional electrical contact comprises a substantially rigid section, a movable section pivotally mounted on the rigid section and terminating in a free end adjacent to the first electrode, the pivot allowing the free end of the movable section to describe an arc passing close to the second electrode and means resiliently biasing the movable section away from the first electrode, the free end of the movable section being connected to the first electrode by the fusible link, which resists the biasing force.

15. A fuse as claimed in claim 1 and including means responsive to fault current passing between the first and second terminals to produce an output signal.

16. A fuse as claimed in claim 15 in which the responsive means is a chemical actuator capable of generating a mechanical output signal in response to fault current.

17. A fuse as claimed in claim 15 in which the responsive means is electrical and is capable of generating an electrical output signal in response to fault current.

18. A fuse as claimed in claim 17 in which the responsive means is a secondary coil spaced from and radially surrounding the said first-mentioned coil.

19. A fuse as claimed in claim 1 and including means for rupturing the fusible element.

20. A fuse as claimed in claim 18 in which said means are operated mechanically.

21. A fuse as claimed in claim 18 in which said means are operated electrically.

22. A fuse as claimed in claim 1 and further comprising electrically conductive means for maintaining exposed external surfaces of said fuse at ground potential.

23. A fuse for an alternating current power circuit in the voltage range of 3.3 kV to 38 kV, the fuse comprising a housing part and a disposable part; the disposable part comprising a first terminal to which a first conductor may be connected; a sealed chamber; a first electrode mounted within the chamber, the first electrode having a substantially circular periphery and being electrically connected to the first terminal; a second electrode with a conductive surface internally of the chamber, the conductive surface being spaced from the first electrode; an additional electrical contact mounted within the chamber; a fusible element directly electrically connected between the first electrode and the additional electrical contact; and an electronegative halogenated medium filling free space within the chamber; the housing part comprising a second terminal to which a second conductor may be connected; a housing made from insulating material and having a first open end into which the disposable part is capable of fitting; contact means capable of making electrical contact with the second electrode when the disposable part is fitted into the housing part; a coil connected in an electrical path between the contact means and the second terminal; the normal current path between the first and second terminals when the disposable part is fitted into the housing part being by way of the first electrode, the fusible element and the additional electrical contact; and the arrangement being such that when the fusible element breaks, the resulting fault current forms an arc between the first electrode and the additional contact, one root of the arc subsequently commutates from the additional contact to the second electrode, the fault current flows through the coil and induces a magnetic field, the magnetic field causes the arc to rotate around the first electrode in the electronegative medium, and the arc is thereby extinguished, so interrupting the fault current.

24. A fuse as claimed in claim 23 and further comprising conductive means for maintaining exposed external surfaces of said insulating housing at ground potential.

25. A fuse as claimed in claim 24 and further comprising additional electrically conductive means for maintaining an exposed internal surface of said housing at a desired potential.

* * * * *